US007543356B2

(12) United States Patent
Zetti

(10) Patent No.: US 7,543,356 B2
(45) Date of Patent: Jun. 9, 2009

(54) SNAP HINGE FOR SUPPORTING CLOSURE ELEMENTS

(75) Inventor: Arrigo Zetti, Via Nonantolana, 1227, 41100 Modena (IT)

(73) Assignee: Arrigo Zetti, Modena (IT)

( * ) Notice: Subject to any disclaimer, the term of this patent is extended or adjusted under 35 U.S.C. 154(b) by 380 days.

(21) Appl. No.: 11/330,146

(22) Filed: Jan. 12, 2006

(65) Prior Publication Data

US 2006/0156513 A1 Jul. 20, 2006

(30) Foreign Application Priority Data

Jan. 18, 2005 (IT) ..... MO2005A0007

(51) Int. Cl.
*E05F 1/08* (2006.01)

(52) U.S. Cl. ..... 16/288; 16/286; 16/238; 16/245

(58) Field of Classification Search ..... 16/286, 16/287, 288, 236, 237, 238, 245, 246; 312/325, 312/326, 327, 328, 329
See application file for complete search history.

(56) References Cited

U.S. PATENT DOCUMENTS

| | | | | |
|---|---|---|---|---|
| 3,363,281 | A * | 1/1968 | Borsani | 16/288 |
| 4,604,769 | A * | 8/1986 | Rock et al. | 16/238 |
| 4,724,578 | A * | 2/1988 | Toyama | 16/240 |
| 4,837,894 | A * | 6/1989 | Lin | 16/288 |
| 5,035,026 | A * | 7/1991 | Carlo et al. | 16/288 |
| 5,058,238 | A * | 10/1991 | Lautenschlager | 16/278 |
| 5,269,043 | A * | 12/1993 | Yang | 16/68 |
| 5,276,944 | A * | 1/1994 | Lin | 16/258 |
| 6,266,848 | B1 * | 7/2001 | Fraccaro et al. | 16/245 |
| 6,374,459 | B1 * | 4/2002 | Zetti | 16/366 |
| 6,618,904 | B1 * | 9/2003 | Nagy | 16/370 |

FOREIGN PATENT DOCUMENTS

| | | |
|---|---|---|
| EP | 0 875 648 A | 11/1998 |
| EP | 0 994 229 A | 4/2000 |

* cited by examiner

*Primary Examiner*—Victor Batson
*Assistant Examiner*—Jeffrey O'Brien
(74) *Attorney, Agent, or Firm*—Modiano & Associati; Albert Josif; Daniel O'Byrne

(57) ABSTRACT

A snap hinge for supporting closure elements, comprising a first articulated quadrilateral and a second articulated quadrilateral, which share a first lever and a second lever and have, as their base element, respectively a plate for coupling to a component designed to be fixed and a plate for fixing to a closure element, at least first elastic elements which act on at least one of the articulated quadrilaterals, and a device for fixing the coupling plate to the component, and a complementary plate, which is adapted to be superimposed on the coupling plate, elements for anchoring the complementary plate to the component, elements for the rectilinear guiding of the coupling plate so that it slides alternately along a direction which is substantially parallel to the plane formed by the component, the elements being formed in the complementary plate, and elements for actuating the coupling plate so that it slides along the guiding elements.

20 Claims, 3 Drawing Sheets

SNAP HINGE FOR SUPPORTING CLOSURE ELEMENTS

The present invention relates to a snap hinge for supporting closure elements.

BACKGROUND OF THE INVENTION

Snap hinges are known which are used particularly but not exclusively for the articulation of closure elements, such as for example the doors or access panels of pieces of furniture or cabinets of caravans, campers and the like, and which in passing from the closed configuration to the open configuration and vice versa rotate about a substantially horizontal axis.

With reference to the doors of wall-mounted cabinets, for example of caravans, campers or of certain kitchens, they generally lie on the vertical plane when they are in the closed configuration and on a horizontal or inclined plane when they are in the open configuration.

Known snap hinges include those provided with a double articulated quadrilateral and with two enclosed springs, which are arranged in series or in parallel and act on mutually opposite parts respectively of the two quadrilaterals or of one of them.

The two articulated quadrilaterals share a first lever and a second lever and have, as their base elements, respectively a coupling plate, which is designed to be fixed to a fixed component of the piece of furniture, cabinet or the like, and a plate for fixing to the closure element.

The coupling plate and the fixing plate lie on mutually parallel planes when the hinge is in the closed configuration and on mutually perpendicular or inclined planes when the hinge is in the open configuration.

Again with reference to the doors of wall-mounted cabinets, the coupling plate is fixed to the internal vertical face of the horizontal wall that delimits the cabinet in an upper region, while the fixing plate is fixed to the face of the door which, in the closed configuration of the cabinet, faces the inside of the cabinet.

Known hinges are provided with a fixing system which consists of threaded means, such as a plurality of screws which are inserted in a corresponding plurality of holes or slots formed through the coupling and fixing plates and engage respectively the component designed to be fixed and the closure element.

In some cases, known hinges are fixed to the component designed to be fixed and to the closure element before fitting such component and such element to the structure of the piece of furniture, cabinet or the like; in particular, the coupling plate is fixed to the fixed component before assembling the fixed component to the structure.

In other cases, instead, the coupling plate of the hinge is fixed to the fixed component, which is preassembled on the structure of the piece of furniture, cabinet or the like, and then the fixing plate is fixed to the closure element.

Once fixing has been performed, assembly errors are possible which relate in particular to the arrangement of the closure element (door) with respect to the fixed component.

In particular, the breadth of the gap between the facing edges of the closure element and of the fixed component may be incorrect.

If this breadth is greater than the optimum value, correct opening/closure of the hinge and of the closure element is prevented; moreover, gaps remain open which alter the aesthetics and architecture of the piece of furniture, cabinet or the like.

Further, errors in parallelism between the facing edges of the closure element and of the fixed component are frequent, the former being inclined with respect to the latter.

In all these cases it is necessary to disassemble the hinge, particularly the fixing plate, from the closure element and/or the coupling plate from the fixed component and perform a new and correct fixing thereof, unscrewing and screwing back in all the screws.

Therefore, these known hinges are not free from drawbacks, which include the fact that the current fixing system does not allow to adjust the position of the closure element with respect to the fixed component and the fact that it does not allow to compensate and correct positioning errors of the closure element with respect to the fixed component.

Another drawback of known hinges is that if the closure element is positioned incorrectly with respect to the fixed component, one is forced to disengage such hinge or hinges and to repeat the assembly operations, which are very laborious and imprecise, with a consequent waste of time.

Another drawback of known hinges is that the operations for assembling and dissembling the coupling plate with respect to the fixed component are very awkward and laborious, both due to the confined and limited maneuvering spaces and due to a limited visual field, which prevent the fitter, for example, from centering precisely the screw passage holes, reaching the various fixing screws, screwing and unscrewing correctly said screws, and handling easily the necessary tools.

Consider, for example, the case in which the coupling plate must be fixed to the internal vertical face of the horizontal wall that delimits in an upper region a wall-mounted cabinet; the fitter cannot check visually his work and cannot handle correctly the necessary tools unless he assumes a very awkward and uncomfortable position.

SUMMARY OF THE INVENTION

The aim of the present invention is to eliminate the abovementioned drawbacks of known hinges, by providing a snap hinge for supporting closure elements which allows to adjust the position of the closure element with respect to the fixed component and to compensate and correct any relative positioning errors thereof.

Within this aim, an object of the present invention is to provide a snap hinge in which the assembly operations, particularly those for fixing the respective coupling plate to the fixed component of a piece of furniture, cabinet or the like, are simple and easy.

Another object of the present invention is to provide a snap hinge which allows a fitter to check visually his work and to handle easily the tools required for correct fixing of said hinge.

A further object of the present invention is to provide a snap hinge which is simple, relatively easy to provide in practice, safe in use, effective in operation, and has a relatively low cost.

This aim and these and other objects that will become better apparent hereinafter are achieved by the present snap hinge for supporting closure elements, of the type which comprises a first articulated quadrilateral and a second articulated quadrilateral, which share a first lever and a second lever and have, as their base element, respectively a plate for coupling to a component designed to be fixed and a plate for fixing to a closure element, at least first elastic means which act on at least one of said articulated quadrilaterals, and a device for fixing said coupling plate to said component, characterized in that said fixing device comprises a complementary plate, which is adapted to be superimposed on said coupling plate, means for anchoring said complementary plate to said component, means for the rectilinear guiding of said coupling plate so that it slides alternately along a direction which is substantially parallel to the plane formed by said component, said means being formed in said complementary plate, and means for actuating said coupling plate so that it slides along said guiding means.

BRIEF DESCRIPTION OF THE DRAWINGS

Further characteristics and advantages of the present invention will become better apparent from the following detailed description of a preferred but not exclusive embodiment of a snap hinge for supporting closure elements, illustrated by way of non-limiting example in the accompanying drawings, wherein.

DESCRIPTION OF THE PREFERRED EMBODIMENTS

Figure 1:
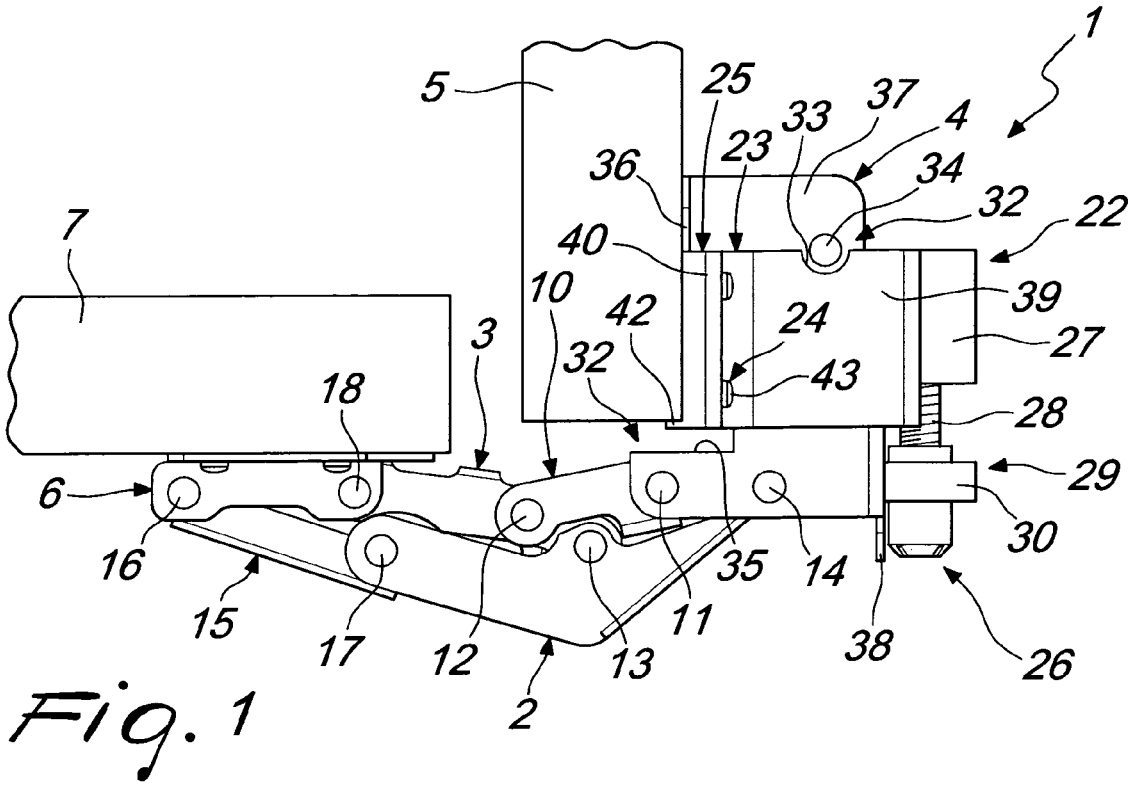
FIG. 1 is a schematic side view of a hinge according to the invention, applied to a closure element in the open configuration.
Figure 2:
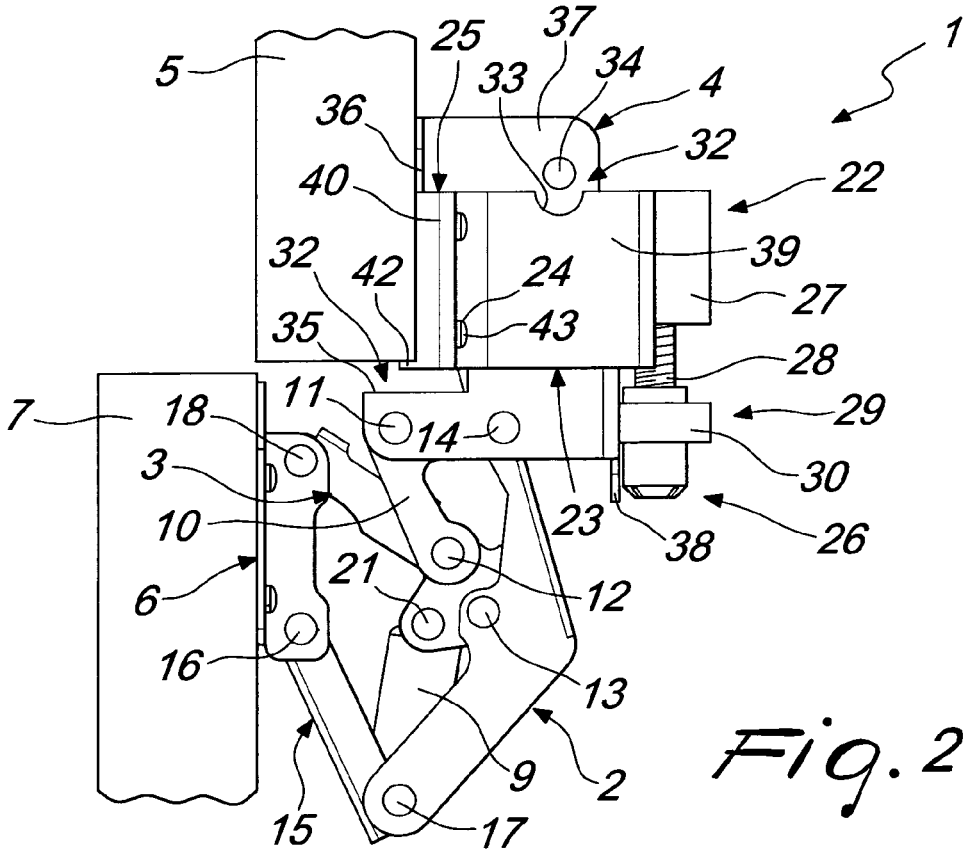
FIG. 2 is a schematic side view of the hinge according to the invention, applied to a closure element in the closed configuration.
Figure 3:
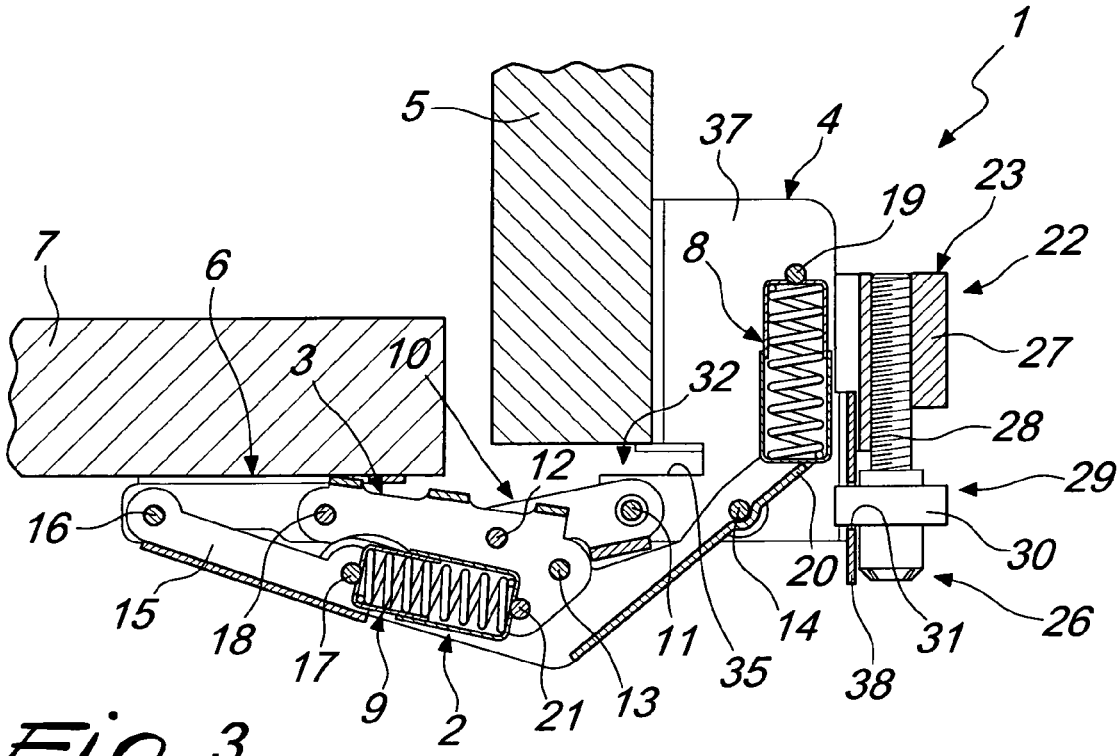
FIG. 3 is a sectional view of FIG. 1.
Figure 4:
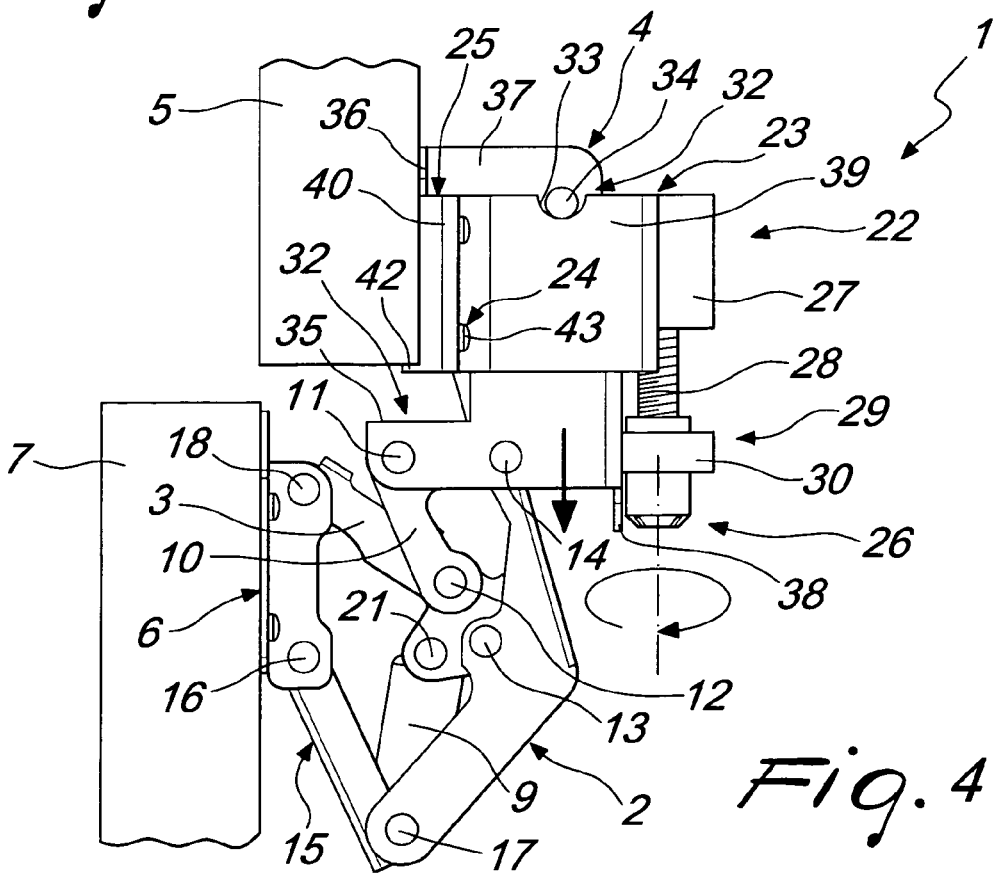
FIG. 4 is a view, similar to FIG. 2, taken during the adjustment of the position of the closure element.
Figure 5:
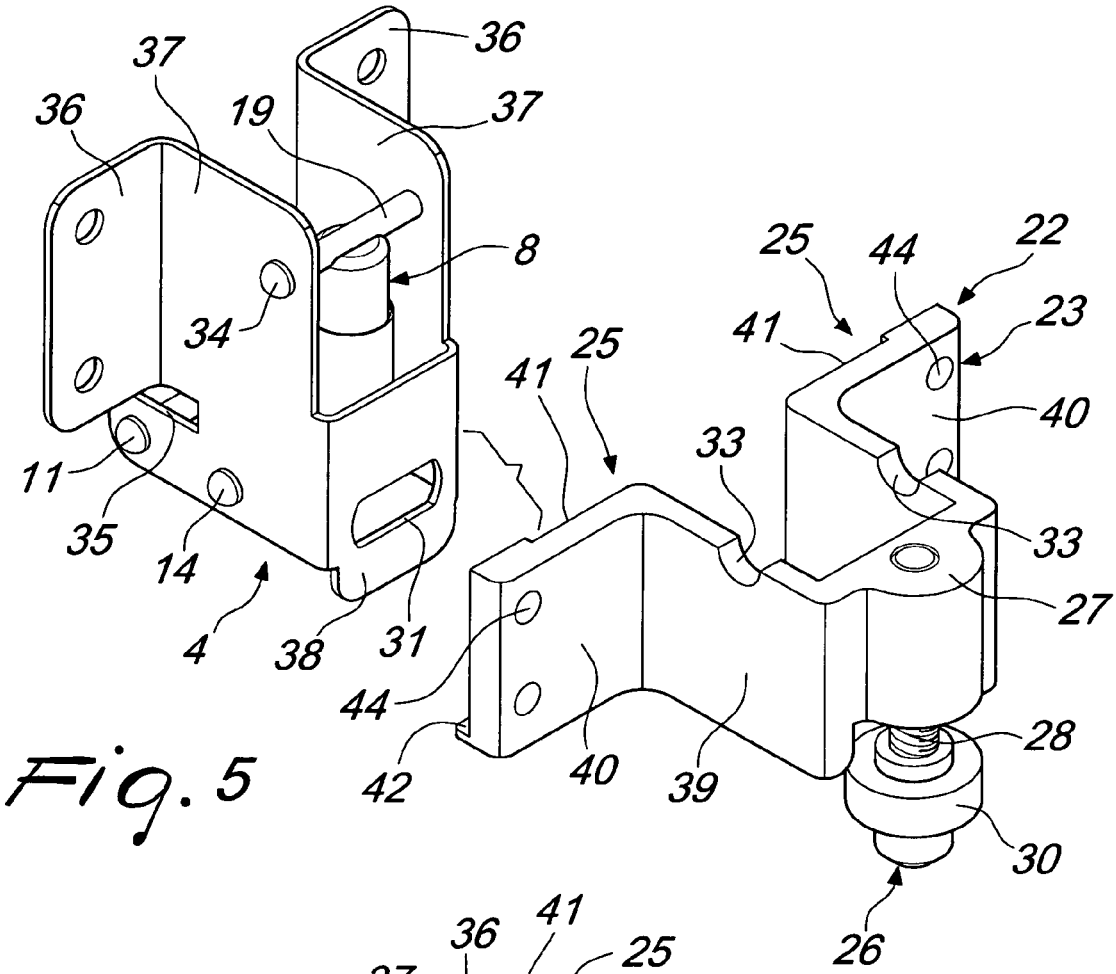
FIG. 5 is a schematic exploded view of the device for fixing the coupling plate to the hinge according to the invention.
Figure 6:
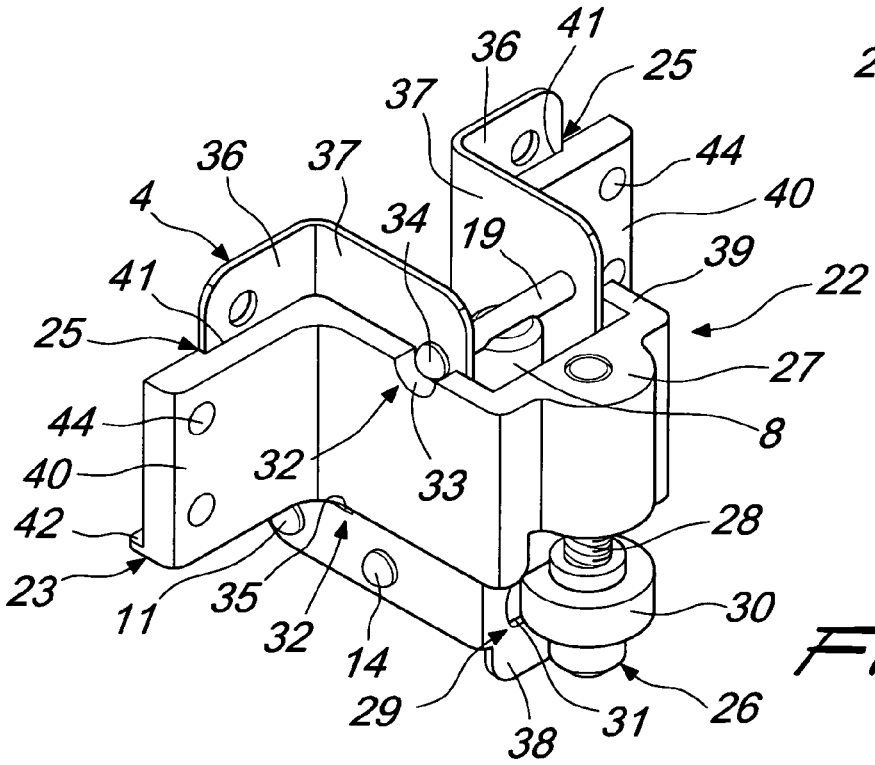
FIG. 6 is a schematic view of the fixing device applied to the coupling plate of the hinge according to the invention.

With reference to the figures, the reference numeral 1 generally designates a snap hinge for supporting closure elements.

The hinge 1 comprises a first articulated quadrilateral and a second articulated quadrilateral, which share a first lever 2 and a second lever 3 and have, as their base element, respectively a plate 4 for coupling to a component 5 designed to be fixed and a plate 6 for fixing to a closure element 7, which is substantially plate-like.

Particularly but not exclusively with reference to wall-mounted cabinets, the component 5 might be constituted by the horizontal wall that delimits in an upper region said cabinet, while the closure element 7 might be constituted by the corresponding door.

When the hinge 1 is in the closed configuration, the coupling plate 4 and the fixing plate 6 lie on planes which are mutually substantially parallel, while the closure element 7, in passing from the closed configuration to the open configuration and vice versa, rotates about a substantially horizontal axis.

In the particular embodiment shown in the figures, the hinge 1 comprises first elastic means 8 and second elastic means 9, which are arranged in series and act on mutually opposite points of the first and second articulated quadrilaterals, respectively.

The first and second elastic means 8 and 9 are of the type of telescopic elastic capsules and are constituted respectively by two mutually opposite elements, which can slide with respect to each other and act as a guide and support for a respective spring.

However, alternative embodiments, not shown, are not excluded in which the hinge 1 can comprise third elastic means, which are arranged in parallel with respect to the first elastic means 8 and/or the second elastic means 9; the second elastic means 9 and the first elastic means 8 can be omitted respectively in one case or the other.

The first articulated quadrilateral is constituted by the coupling plate 4, by a first arm 10, by the second lever 3 and by the first lever 2, which are articulated respectively about a first pivot 11, a second pivot 12, a third pivot 13 and a fourth pivot 14.

The second articulated quadrilateral is constituted by the fixing plate 6, by a second arm 15, by the first lever 2 and by the second lever 3, which are articulated respectively about a fifth pivot 16, a sixth pivot 17, the third pivot 13 and a seventh pivot 18.

The first elastic means 8 act between an eighth pivot 19, which is articulated to the coupling plate 4, and a contoured articulation element 20, which is formed in the second lever 2.

The second elastic means 9 act between a ninth pivot 21 and the sixth pivot 17.

The hinge 1 further comprises a device 22 for fixing the coupling plate 4 to the component 5, which is adapted to adjust the relative position of the closure element 7 with respect to the component 5 and in particular to adjust the breadth of the gap formed between their mutually facing edges and their parallelism (if at least two hinges 1 are used).

The fixing device 22 comprises a complementary plate 23, which is adapted to be superimposed on the coupling plate 4, means 24 for anchoring the complementary plate 23 to the component 5, means 25, formed in the complementary plate 23, for the rectilinear guiding of the coupling plate 4 so that it slides in a reciprocating manner along a direction which is substantially parallel to the plane traced by the component 5, and means 26 for actuating the coupling plate 4 so that it slides along the rectilinear guiding means 25.

The actuation means 26 are associated with the complementary plate 23 and can comprise for example an actuation or translational motion screw, which is substantially parallel to the direction of the sliding of the coupling plate 4, said direction being substantially perpendicular to the plane that is perpendicular to the plane defined by the component 5.

In the embodiment shown, the actuation means 26 comprise a female thread 27, which is monolithic with the complementary plate 23 and mates with a screw 28, means 29 for coupling the screw 28 to the coupling plate 4 being provided which are adapted to prevent the relative translational motion of one with respect to the other.

However, alternative embodiments of the actuations means 26 are not excluded and might be constituted, for example, by an actuation or translational motion screw, in which the female thread is formed monolithically with the coupling plate 4 and the corresponding screw is associated with the complementary plate 23 by way of means for restraining the relative translational motion of one with respect to the other.

The restraining means 29 can comprise, for example, an annular collar 30, which is formed within the screw 28 and is accommodated, so that it can rotate freely, in a corresponding seat 31 formed in the coupling plate 4.

The fixing device 22 further comprises means 32 for stopping the sliding of the coupling plate 4 both in the direction in which the closure element 7 moves away from the component 5 and in the direction in which it moves toward said component.

The stop means 32 further comprise at least one recess 33, which is formed within the complementary plate 23 and is adapted to engage a corresponding stop tooth 34 formed in the coupling plate 4; the engagement of the stop tooth 34 in the recess 33 blocks the sliding of the coupling plate 4 in the direction in which the closure element 7 moves away from the component 5.

The stop means 32 further comprise at least one wall 35 which protrudes, substantially at right angles to the plane formed by the component 5, from the edge of the coupling plate 4 that faces the closure element 7; the wall 35 is adapted to abut against the edge of the component 5 in order to block the sliding of the coupling plate 4 in the direction in which the element 7 moves closer to the component 5.

The coupling plate 4 comprises two bases 36 for contact against the component 5, from which respective sides 37 protrude which are mutually interconnected by a connecting bridge 38.

The contact bases 36 are associated slidingly with the rectilinear guiding means 25.

The holes for accommodating the end of the first pivot 11, of the fourth pivot 14 and of the eighth pivot 19 are formed in each side 37; the heads of the opposite ends of the eighth pivot 19 protrude from the sides 37 and form corresponding stop teeth 34.

The seat 31 in which the annular collar 30 is inserted is formed in the connecting bridge 38.

Finally, a corresponding wall 35 protrudes from each side 37 in order to stop the sliding of the coupling plate 4.

The complementary plate 23 comprises a bracket 39, which is made of metal, plastics or other material and is adapted to be arranged astride the connecting bridge 38 and the sides 37; corresponding wings 40 protrude from the opposite ends of said bracket and are adapted to be superimposed on the contact bases 36.

The female thread 27 is formed in the bracket 39, while on the face of the wings 40 that is directed toward the component 5 there are channels (flat portions) 41, which constitute the rectilinear guiding means 25 along which the contact bases 36 are coupled slidingly.

The wings 40 are further provided with a reference lip 42, which is substantially perpendicular thereto and is adapted to abut against the edge of the component 5 for the positioning of the complementary plate 23.

Corresponding recesses 33 are formed on the opposite sides of the bracket 39 and are designed to interfere with the stop teeth 34 formed by the heads of the opposite ends of the eighth pivot 19.

The anchoring means 24 comprise threaded means, such as screws 43, which can be inserted in corresponding through holes 44 formed in the wings 40 and engage the component 5.

Particularly but not exclusively with reference to the fitting of the hinge 1 on a cabinet, for example of the wall-mounted type, of a caravan, camper or kitchen, the component 5 is constituted by the upper horizontal wall, which delimits the cabinet, and the closure element 7 is constituted by the respective closure door.

Two hinges 1 are generally used for each closure element 7.

If it is necessary to fit the hinges 1 to the component 5 when it is already assembled to the structure of the cabinet, the respective coupling plates 4 are associated with the rear face of the component 5 by anchoring the complementary plates 23 of the corresponding fixing devices 22 by means of the screws 43, the coupling plates being free to slide along the rectilinear guiding means 25.

By acting on the actuation means 26 (actuation or translational motion screw) of the fixing device 22 of each hinge 1, it is possible to adjust the position of the closure element 7 with respect to the component 5, adjusting both the breadth of the gap formed between the mutually facing edges of the closure element 7 and of the component 5 and the mutual parallelism of said edges, without having to disassemble and reassemble the hinges 1 in case of errors or inaccuracies.

It is noted that the actuation means 26 can be accessed and actuated easily by the fitter, who can thus check visually his work and manipulate with great freedom the necessary tools in a manner which is simple and easy.

In practice it has been found that the described invention achieves the proposed aim and objects.

The invention thus conceived is susceptible of numerous modifications and variations, all of which are within the scope of the appended claims.

All the details may further be replaced with other technically equivalent ones.

In practice, the materials used, as well as the shapes and the dimensions, may be any according to requirements without thereby abandoning the scope of the protection of the appended claims.

The disclosures in Italian Patent Application No. MO2005A000007 from which this application claims priority are incorporated herein by reference.

What is claimed is:

1. A snap hinge for supporting closure elements, comprising a first articulated quadrilateral and a second articulated quadrilateral, which share a first lever and a second lever and have, as their base element, respectively, a coupling plate for coupling to a component designed to be fixed and a plate for fixing to a closure element, at least a first elastic means which acts on at least one of said articulated quadrilaterals, and a device for fixing said coupling plate to said component, wherein said fixing device comprises a complementary plate, which is adapted to be superimposed on said coupling plate, means for anchoring said complementary plate to said component, rectilinear guiding means for rectilinear guiding of said coupling plate whereby said coupling plate is slidable alternately along a direction which is substantially parallel to the plane formed by said component, said rectilinear guiding means being formed in said complementary plate, actuation means for actuating said coupling plate for sliding along said guiding means, and stop means for stopping the sliding of said coupling plate, said stop means comprising at least one recess formed in said complementary plate and at least one stop tooth adapted to engage said at least one recess, wherein said coupling plate comprises two bases for contact against said component that have respective sides protruding therefrom, the sides being mutually connected by a connecting bridge and being each provided with at least one hole, said bases being slidingly associated with said guiding means, and wherein at least one corresponding pivot is further provided that has opposite ends thereof accommodated each in a respective said at least one hole for articulation of one of said first and second articulated quadrilaterals and of said first elastic means, said at least one stop tooth being formed by an end head provided on at least one of said opposite ends of said at least one pivot accommodated in a said at least one hole provided on a said side, the end head protruding from said side.

2. The binge of claim 1, wherein said actuation means are associated with said complementary plate.

3. The hinge of claim 1, wherein said actuation means comprise an actuation or translational motion screw.

4. The hinge of claim 3, wherein said actuation screw is substantially parallel to said direction.

5. The binge of claim 1, wherein said direction is substantially perpendicular to the plane that lies at right angles to a plane formed by said component.

6. The hinge of claim 3, wherein said actuation or translational motion screw comprises a female thread, which is monolithic with said complementary plate, and a screw, which is mated with said female thread, means for coupling said screw to said coupling plate being provided which are adapted to prevent the relative translational motion of one with respect to the other.

7. The hinge of claim 3, wherein said actuation or translational motion screw comprises a female thread, which is rigidly coupled to said coupling plate, and a screw, which is coupled to said female thread, means for restraining said screw with respect to said complementary plate being provided which are adapted to prevent the relative translational motion of one with respect to the other.

8. The hinge of claim 7, wherein said restraining means comprise an annular collar which is formed in said screw and is accommodated for free rotation, in a corresponding seat formed within said coupling plate or said complementary plate.

9. The hinge of claim 8, wherein said seat is formed in said connecting bridge.

10. The hinge of claim 1, wherein said anchoring means comprise threaded means.

11. The binge of claim 1, further comprising second elastic means, which act on the other one of said first and second articulated quadrilaterals in series with respect to said first elastic means.

12. A snap hinge for supporting closure elements, comprising a first articulated quadrilateral and a second articulated quadrilateral, which share a first lever and a second lever and have, as their base element, respectively, a coupling plate for coupling to a component designed to be fixed and a plate for fixing to a closure element, at least a first elastic means which acts on at least one of said articulated quadrilaterals, and a device for fixing said coupling plate to said component, wherein said fixing device comprises: a complementary plate, which is adapted to be superimposed on said coupling plate; means for anchoring said complementary plate to said component; rectilinear guiding means for rectilinear guiding of said coupling plate whereby said coupling plate is slidable alternately along a direction which is substantially parallel to the plane formed by said component, said rectilinear guiding means being formed in said complementary plate; actuation means comprising a translational motion screw for actuating said coupling plate for sliding along said guiding means, said translational motion screw comprising a female thread, which is rigidly coupled to said coupling plate, and a screw, which is coupled to said female thread; restraining means for restraining said screw with respect to said complementary plate and adapted to prevent a relative translational motion of the screw with respect to the coupling plate, said restraining means comprising an annular collar which is formed in said screw and is accommodated for free rotation in a corresponding seat formed within a connecting bridge of the coupling plate.

13. The hinge of claim 12, wherein said fixing device comprises means for stopping the sliding of said coupling plate.

14. The hinge of claim 13 wherein said stop means comprise at least one recess which is formed in said complementary plate and is adapted to engage a corresponding stop tooth formed in said coupling plate.

15. The hinge of claim 13, wherein said stop means comprise at least one wail which protrudes, substantially at right angles to the plane formed by said component, from an edge of said coupling plate which faces said closure element, said wall being adapted to abut against an edge of said component.

16. The hinge of claim 12 wherein said coupling plate comprises two bases for contact against said component, from which respective sides protrude which are mutually connected by a connecting bridge, said bases being associated slidingly wit said guiding means.

17. The hinge of claim 16, wherein each one of said sides comprises at least one hole for accommodating the end of at least one corresponding pivot for the articulation of one of said first and second articulated quadrilaterals and/or of said first elastic means, said stop tooth being formed by the end head of one of said pivots, which protrudes from the corresponding side.

18. The hinge of claim 16, wherein each one of said sides is extended by means of a corresponding said wall.

19. The hinge of claim 16, wherein said complementary plate comprises a bracket which is adapted to be arranged astride said bridge and said sides and from the opposite ends of which corresponding wings protrude, said wings being adapted to be superimposed on said contact bases, said female thread being formed in said bracket and said guiding means being formed by flat portions formed within said wings.

20. The hinge of claim 19, wherein said wings comprise a reference lip, which is substantially perpendicular thereto and is adapted to abut against the edge of said component.

* * * * *